US005111894A

United States Patent [19]

Williams, Jr.

[11] Patent Number: 5,111,894

[45] Date of Patent: May 12, 1992

[54] UNINTERRUPTED DRILL BIT

[75] Inventor: Edward B. Williams, Jr., College Station, Tex.

[73] Assignee: Sybil J. Williams, Bryan, Tex.

[21] Appl. No.: 657,293

[22] Filed: Feb. 19, 1991

Related U.S. Application Data

[63] Continuation of Ser. No. 574,497, Aug. 23, 1990, abandoned, which is a continuation of Ser. No. 476,123, Feb. 2, 1990, abandoned, which is a continuation of Ser. No. 352,690, May 10, 1989, abandoned, which is a continuation of Ser. No. 224,270, Jul. 25, 1988, abandoned, which is a continuation of Ser. No. 78,263, Jul. 27, 1987, abandoned.

[51] Int. Cl.[5] ..... E21B 10/12

[52] U.S. Cl. ..... 175/373; 175/374; 175/376; 175/339

[58] Field of Search ..... 175/373, 374, 376, 351, 175/352, 339, 340, 409

[56] References Cited

U.S. PATENT DOCUMENTS

| | | | |
|---|---|---|---|
| 1,657,604 | 1/1928 | Bell | 175/339 |
| 2,223,864 | 12/1940 | Zublin | 175/373 |
| 2,310,289 | 2/1943 | Hokanson | 175/373 |
| 2,708,105 | 5/1955 | Williams, Jr. . | |
| 2,776,115 | 1/1957 | Williams, Jr. . | |
| 2,994,390 | 8/1961 | Hildebrandt | 175/374 |
| 3,081,829 | 3/1963 | Williams, Jr. | 175/376 |
| 3,113,630 | 3/1964 | Williams, Jr. | 175/340 |
| 3,126,066 | 3/1964 | Williams, Jr. | 175/336 |
| 3,144,087 | 8/1964 | Williams, Jr. | 175/339 |
| 3,358,782 | 12/1967 | Bechem | 175/373 |
| 3,412,817 | 11/1968 | Reichmuth | 175/374 |
| 3,844,363 | 10/1974 | Williams, Jr. | 175/227 |
| 3,881,560 | 5/1975 | Williams, Jr. | 175/337 |
| 3,923,108 | 12/1975 | Williams, Jr. | 175/227 |
| 3,923,109 | 12/1975 | Williams, Jr. | 175/340 |
| 4,077,482 | 3/1978 | Ioannesian et al. | 175/340 |
| 4,706,765 | 11/1987 | Lee et al. | 175/373 |

*Primary Examiner*—Hoang C. Dang

*Attorney, Agent, or Firm*—Litman, McMahon & Brown

[57] ABSTRACT

A drill bit for drilling in the ground includes a pair of drilling cones having axes of rotation that converge near a drilling center of the bit. The cones each include a plurality of ridges or uninterrupted cutting edges. The cutting edges of each cone are separated by troughs. During rotation of the bit, the cutting edges of one cone are aligned so as to pass along the path traversed by the troughs of the opposite cone and vice versa. Drilling fluid jets are provided and flow connect with a drilling fluid supply to provide drilling fluid under pressure for cleaning and lubrication to the cones as well as to sweep away debris dislodged by the cutting action of the cones.

2 Claims, 2 Drawing Sheets

Fig. 5.
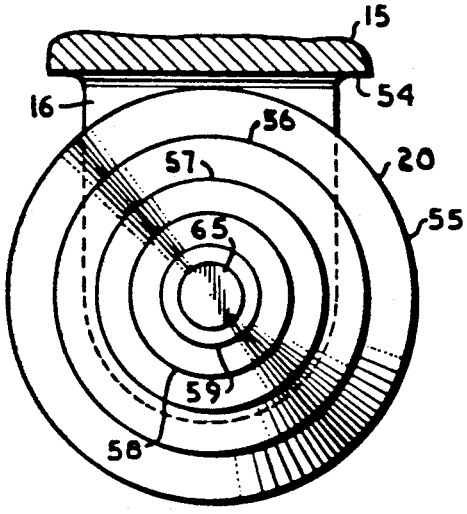
Fig. 6.
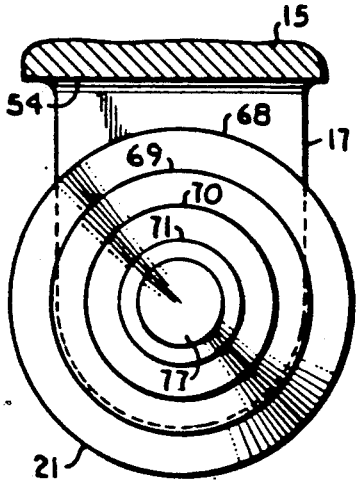
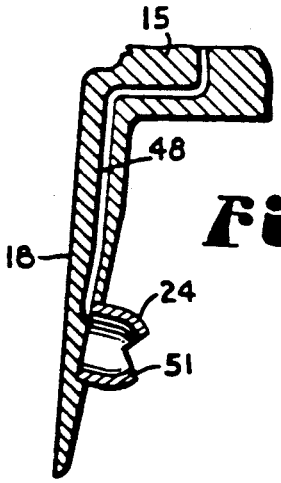
Fig. 7.
Fig. 8.
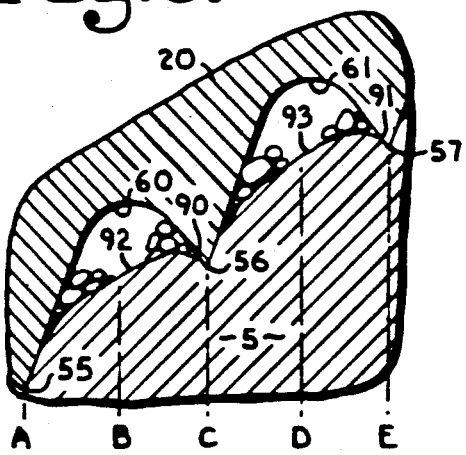
Fig. 9.
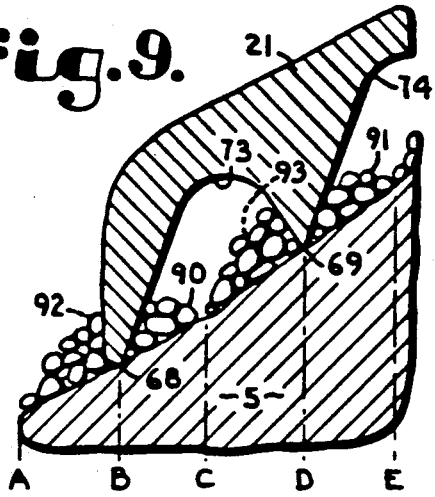

UNINTERRUPTED DRILL BIT

The present application is a continuation of prior application Ser. No. 574,497, filed Aug. 23, 1990, now abandoned, which is a continuation of prior complete application Ser. No. 476,123, filed Feb. 2, 1990, and now abandoned; which was a continuation of prior complete application Ser. No. 352,690, filed May 10, 1989, and now abandoned; which was a continuation of prior complete application Ser. No. 224,270, filed Jul. 25, 1988, and now abandoned; which was a continuation of prior complete application Ser. No. 078,263, filed Jul. 27, 1987, and now abandoned.

BACKGROUND OF THE INVENTION

The present invention relates to drilling tools for boring holes into the earth and, in particular, to a drilling tool especially suited for the oil well drilling industry and for boring deep wells for use in generation of electrical power by converting water pumped through the well into steam so as to run a generator.

Because of the substantial cost of drilling wells, the drilling industry is constantly attempting to improve the efficiency of drilling bits, since even a minor improvement in the efficiency of a bit can result in substantial savings in the overall drilling of a well.

Drill bits utilizing rotating cones having outwardly projecting serrated teeth, discrete carbide lugs or the like have been utilized for many years in the drilling industry. Applicant of the present application has developed drill bits of this type over the years and is the holder of many United States patents for such drill bits.

However, through extended study, applicant has found that the drill bits of the prior art having spaced teeth, lugs or the like have certain inherent inefficiencies. For example, it has been found that drill bits having cones with teeth projecting therefrom typically require approximately at least three and often as many as eight rotations of the bit for the teeth to completely create a single substantially continuous groove or cut into an imaginary circumferential layer such that the first layer is broke away and the teeth can start working on the second layer.

A more serious problem is that the teeth tend to be aligned on the various cones such that a following set of teeth tend to drag in the track of a predecessor set of teeth. That is, the bit tends to suffer from the same inefficiency realized when a vehicle with a set of tires tries to follow in the muddy tracks of a predecessor vehicle and finds that it spends much of its time and energy spinning rather than digging in and obtaining traction.

Consequently, applicant determined that, in order to improve the efficiency of a drill bit of this type, it was necessary to provide a bit having a continuous, uninterrupted cut such that, with each revolution, the exposed surface of the ground would receive a complete circumferential cut. In addition, applicant determined that it was necessary to have the cutting edges of one set of cones offset from the cutting edges of a second set of cones so as to avoid having a trailing set of cutting edges slide in the tracks of predecessor cutting edges.

In designing such a drill bit, applicant also discovered a synergistic effect between his cutting edges such that one set of cutting edges has a tendency to dig into the surface and the other set of cutting edges has a tendency to shatter the rock or soil between the first set of cutting edges substantially reducing the pressure required on the bit and also substantially reducing the work required to rotate the bit since significantly fewer rotations are required to make a bore of a given depth, thereby producing an extremely efficient bit.

OBJECTS OF THE INVENTION

Therefore, the principal objects of the present invention are: to provide a highly efficient drill bit capable of achieving a relatively large depth of cut in return for relatively little expenditure of energy required to rotate the bit and to apply pressure to the bit; to provide such a bit having rotating cones thereon; to provide such cones with an uninterrupted or continuous cutting edge or ridge; to provide multiple cones having multiple cutting edges thereon aligned such that the cutting edges of a following cone do not follow in the track of a preceeding cone; to provide such a bit wherein the uninterrupted cutting edges are continuous ridges separated by arcuate troughs generally equally spaced along the surface of each cone; to provide such a bit including a drilling fluid distribution system for effectively lubricating the cones and for sweeping away debris dislodged by the cones; to provide such a bit wherein the cones are self-cleaning; to provide such a bit which is relatively simple to manufacture, easy to use, and exceptionally efficient in drilling into the earth.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 5 is an enlarged, fragmentary and side elevational view of a first cone of the bit showing a portion of an arm supporting the first cone.

FIG. 6 is an enlarged, fragmentary and side elevational view of a second cone of the bit, also partially showing a supporting arm associated with the second cone.

FIG. 7 is an enlarged, fragmentary and cross-sectional view of the fluid distribution nozzles and a support arm thereof, taken along line 7—7 of FIG. 4.

FIG. 8 is an enlarged, fragmentary and cross-sectional view of the first cone showing cutting edges thereof engaging a layer of rock and including position reference lines.

FIG. 9 is an enlarged, fragmentary and cross-sectional view of the second cone as it sweeps the rock surface shown in FIG. 8 and including the same position reference lines as shown in FIG. 8 for comparative purposes.

DETAILED DESCRIPTION OF THE INVENTION

Figure 1:
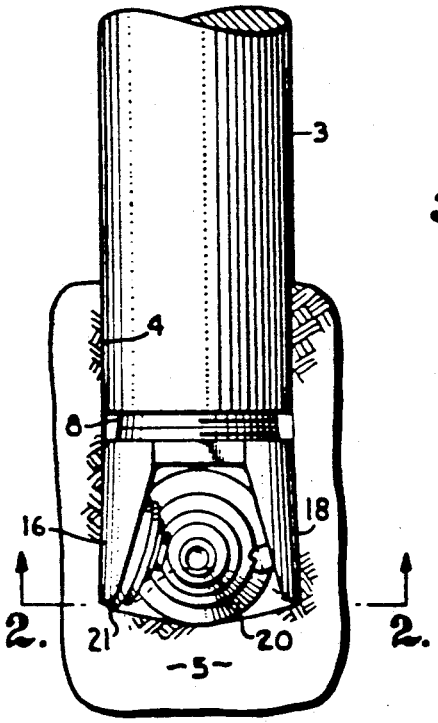
FIG. 1 is a side elevational view of a drill bit, in accordance with the present invention, attached to a drilling pipe string and positioned within a bore being drilled in the ground.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a drill bit mounted upon the lower end 2 of a string 3 of drilling pipe and positioned in a bore 4 with the string of drilling pipe 3 extending to the upper end of the bore 4 and attached to a conventional drilling rig (not shown). The pipe 3 includes an interior bore 7 extending from the upper end thereof to the lower end 2. The bit 1 is threadably secured to the lower end of the pipe 2 by threaded surfaces 8 and 9 on the bit 1 and pipe 3 respectively. It is noted that there is sufficient clearance between the pipe string 3 and the wall of the bore 4 to allow flow of drilling fluid carrying debris therebetween.

The drill bit 1 includes a head or body 15 with three approximately equally circumferentially spaced arms 16, 17 and 18 depending from a radially outer portion thereof. Rotatably mounted on arms 16 and 17 are cutting cones 20 and 21 respectively. Mounted on arm 18 are a pair of drilling fluid distribution nozzles 23 and 24. The lateral centers of each of the arms 16, 17 and 18 are spaced approximately 120° from one another. Arms 16 and 17 include inwardly directed mounting nipples or projections 25 and 26 generally mating with internal cavities 28 and 29 in the cones 20 and 21 respectively. Near a radially inward end of each of the projections 25 and 26 are respective circumferential grooves 31 and 32 each receiving keeper rings 33 and 34.

The cones 20 and 21 have mating grooves 37 and 38 which are also positioned to receive the keeper rings 33 and 34 respectively. Each of the arms 16 and 17 include internal bores 40 and 41 receiving plugs 42 and 43 respectively. When positioned in the arms 16 and 17 with cones 20 and 21 in operative position, the plugs 42 and 43 bias the keeper rings 33 and 34 such that the rings 33 and 34 overlap and are positioned in both grooves 31 and 37 as well as in grooves 32 and 38 respectively. This effectively locks the cones 20 and 21 to the arms 16 and 17. Seals 46 and 47 near the base of respective cones 20 and 21 seal between the respective cones 20 and 21 and the mounting projections 25 and 26 to keep rock debris out and maintain lubricating grease therebetween.

The bit body 15 includes an upper internal bore 45 positioned to flow communicate with the pipe bore 7. A conduit 48 extends from an aperture 49 flow communicating with the bore 45 to oval shaped apertures 50 and 51 in the nozzles 23 and 24 respectively. In this manner, drilling fluid may pass through the pipe bore 7 into the bit bore 45 through the aperture 49, the conduit 48 and out the apertures 50 and 51 in the nozzles 23 and 24 for lubrication and cleaning of the cones 20 and 21 as well as sweeping removal of rock debris loosened by the cones 20 and 21.

It is foreseen that drilling fluid may be distributed in accordance with the present invention by nozzles positioned in positions other than those shown. For example, three nozzles communicating with the bore 45 may be positioned along the underside 54 of the body 15 so as to be equally spaced from one another and such that one of the nozzles is approximately equally spaced between the arms 16 and 17.

Figure 2:
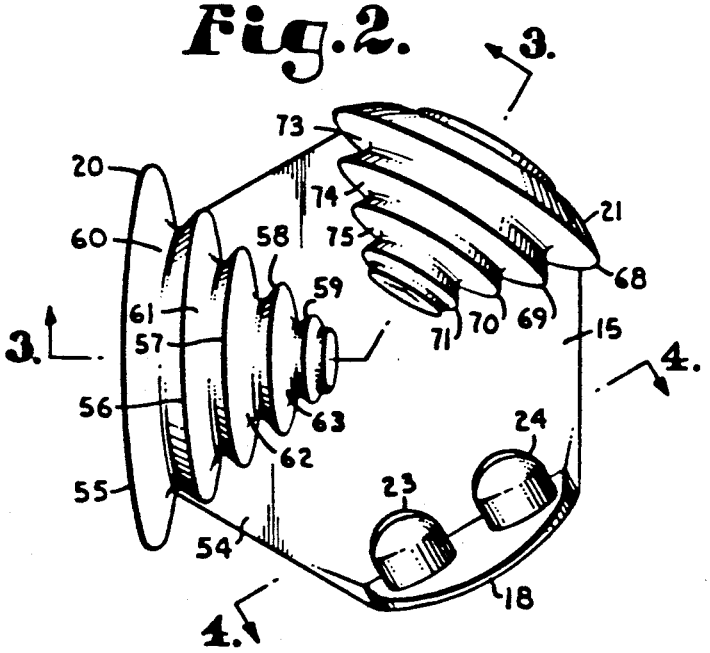
FIG. 2 is an enlarged bottom plan view of the bit, taken along line 2—2 of FIG. 1.

The structures of the cones 20 and 21 are quite important to the present invention. The outer extremities of the cones 20 and 21 generally define a conical configuration and the axes associated with such conical configuration are aligned to tilt slightly downward (approximately 8° from true horizontal when the string of drilling pipe 3 and the drill bit 1 are operating in a true vertical alignment) and radially inward or toward the imaginary point of the conical configuration such that the cones 20 and 21 each have an axis of rotation angled 82° relative to an axis of rotation f the drill bit 1. The axes of the cones 20 and 21 are also aligned at approximately 120° from one another when seen from the top, as shown in FIG. 2 and intersect near a radial center of the bit.

The cone 20 is larger than the cone 21. The cone 20 also includes a series of five circumferential and generally continuous cutting edges or ridges 55, 56, 57, 58, and 59 which are generally parallel spaced from one another, from the base of the cone 20 and are also separated by valleys, troughs, grooves or channels 60, 61, 62 and 63 respectively. As seen in FIG. 8, the channels 60, 61 (as well as the channels 62 and 63) are arcuate and relatively smooth in shape, having a substantially parabolic configuration. The ridges 55, 56 and 57 (as well as ridges 58 and 59), also as seen in FIG. 8, are relatively sharp edged and are designed for digging into, cutting or grooving rock or other soil. S The channels 60, 61, 62 and 63 allow the ridges 55, 56, 57, 58 and 59 to cut into the rock without substantial interference from the remainder of the cone 20. The cone 20 has a relatively blunted end 65 with a slightly inwardly projecting arcuate surface. The innermost edge of each of the ridges 55, 56, 57, 58 and 59 are substantially circular and equally radially spaced throughout from the axis of the cone 20. The diameter of the ridges starting nearest the base of the cone 20 become progressively smaller for successive ridge edges.

The cone 21 has a series of four cutting edges or ridges 68, 69, 70 and 71 which extend uninterruptedly and circumferentially thereabout at substantially equally spaced and parallel positions. The ridges 68, 69, 70 and 71 are separated by channels 73, 74 and 75 respectively. The ridges of the cone 20 are positioned so as to circumferentially align with the respective channels of the cone 21 and the ridges of the cone 21 are aligned to circumferentially align with the channels of the cone 20 as the drill bit 1 is rotated. A radially inward end 77 of the cone 21 is blunted and has a slightly concave surface associated therewith.

Figure 3:
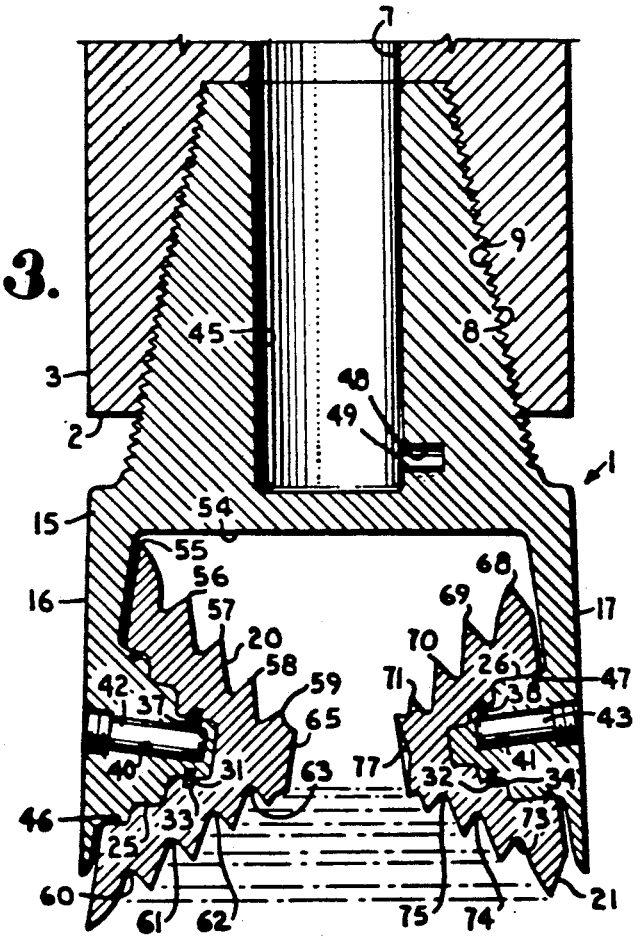
FIG. 3 is an enlarged cross-sectional view of the bit, taken along line 3—3 of FIG. 2, including phantom lines showing the alignment of ridges on cones associated with the bit.
Figure 4:
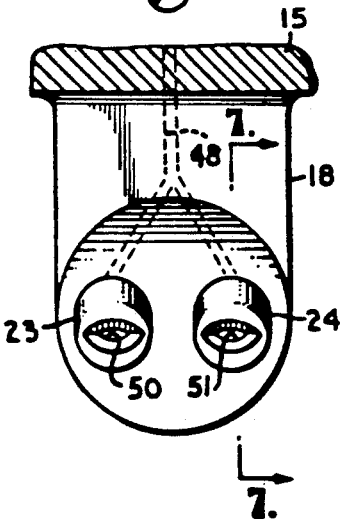
FIG. 4 is an enlarged cross-sectional view of the bit, taken along line 4—4 of FIG. 2, showing drilling fluid distribution nozzles thereof with a fluid conduit being shown in phantom.

The alignment of the ridges or cutting edges of each of the cones 20 and 21 with the channels or non-cutting surfaces of the opposite cone is illustrated in FIG. 3. In this manner, ridges of the cones 20 and 21 are effectively misaligned so that the cutting edges of one cone will not traverse the same paths or engage the same cuts in the ground as the other cone. This is further illustrated in FIGS. 8 and 9 wherein the cones 20 and 21 are shown in approximately the same position relative to a particular ground surface being drilled so as to illustrate the relative position of the respective ridges and channels. As the large or first cone 20 passes over the surface of the ground 5, as seen in FIG. 8, the ridges 55, 56 and 57 as well as the other ridges or cutting edges dig into and groove the surface providing grooves 90 and 91 with rock humps 92 and 93 therebetween. As the bit is rotated 120°, the smaller cone 21 is positioned over the same location as is seen in FIG. 8 and this is illustrated in FIG. 9. The reference lines a, b, c, d and e shown in FIGS. 8 and 9 indicate the relative position of the cones over the ground 5.

As the small cone 21 passes over the same region as has just been traversed by the large cone 20, seen comparatively in FIGS. 8 and 9, the ridges or cutting edges such as 68 and 69 of the cone 21 pass over the middle of the humps 92 and 93 respectively and between the grooves (for example, ridge 69 passes between grooves 90 and 91) formed by the ridges of the large cone 20. It is foreseen by applicant that this has a tendency to shatter the material therebetween, as is shown in FIG. 9. It is noted that the illustrations of FIGS. 8 and 9 are for purposes of illustrating a concept and that, in actual practice, it is seen that the small cone 21 could cut grooves in the ground surface 5 and that the ridges or cutting edges of the large cone 20 could shatter the material between such grooves or it could be that there is a combination of groove cutting and subsequent shattering of humps by both cones 20 and 21 while simultaneously cutting new groove lower than the surrounding rock surface.

The ratio of the base to height of both of the cones 20 and 21 is preferably 1.8:1 and the ratio of the large cone 20 to the small cone 21 is preferably 1.15:1.

While two cones are illustrated in the present embodiment, it is foreseen that three or more cones could be utilized in accordance with the present invention and that the uninterrupted cutting edge works effectively as a single cone, but a better synergistic effect is realized with at least two cones. While it is preferred that the cones be constructed of a generally uniform metal, ceramic, or the like capable of withstanding substantial pressures and heat and having a relatively high hardness (preferably 8 or greater), it is foreseen that the ridges could be of a continuous, but dissimilar, material from the remainder of the cones or that the ridges could be formed by close spacing of lugs positioned in a circumferential manner about the cone so as to form a substantially uniform and continuous cutting edge. For example, the cones may be constructed of molded tungsten carbide or of machined steel with a tungsten carbide band or rim attached at the cutting edges or steel with tungsten carbide lugs closely spaced to present a relatively smooth uniform surface at the cutting edges and being imbedded in steel.

In use, the drill 1 is positioned within the bore 4 in the ground 5 and rotated. Upon rotation, the cutting edges or ridges associated with one or both of the cones 20 and 21 cut into the exposed surface of the ground 5 and form circumferential humps (such as hump 93) between grooves (such as grooves 90 and 91) so cut. Subsequently, the cutting surface or ridges of the opposite cone pass over the center of the humps formed by the previous cone and tend to shatter the rock or other earth between the grooves. In this manner, on each rotation of the bit, a substantially 360° circumferential groove is made in the surface of the ground 5 by each of the cutting edges or ridges of at least one of the cones 20 or 21. In addition, the material between adjacent grooves on the surface of the ground 5 is subsequently passed over by the cutting edge or ridge of the following cone which is believed to have a tendency to shatter the material between the grooves and, consequently, substantially reduce the amount of work and drilling pressure required to drill. On initial testing, it appears that possibly as little as 10% of the energy output was required to drill a hole of equivalent depth with a bit made in accordance with the present invention as compared to bits of the prior art.

It is to be understood that while certain forms of the present invention have been illustrated and described herein, it is not to be limited to the specific forms or arrangement of parts described and shown.

What is claimed and desired to be secured by Letters Patent is as follows:

1. A set of cones adapted for use with a drill bit for drilling a bore in the earth; said set of cones comprising:

(a) first and second cones each having bases and axes of rotation and each being adapted to be rotatably mounted on a drill bit;

(b) said first cone having attached thereto and extending radially outward therefrom in adjacent and spaced alignment a plurality of cutting edges; each of said cutting edges being generally continuous and circular so as to provide a generally uninterrupted cut on a surface over which said first cone is rotated;

(c) said second cone having attached thereto and extending radially outward therefrom in adjacent and spaced alignment one less cutting edge than said first cone; said cutting edges of said second cone being generally continuous and circular so as to provide a generally uninterrupted cut on a surface over which said second cone bit is rotated; and wherein:

(d) said first and second cones are adapted to be secured to a drill bit such that at least one cutting edge of said second cone is interspaced between a pair of adjacent cutting edges of said first cone such that a path of at lest one cutting edge of said second cone passes between paths traversed by a pair of adjacent cutting edges of said first cone;

(e) said cutting edges of said first and second cone are parallel to a base of each of said first and second cone; each of said cutting edges being smaller than a previous cutting edge starting at the cutting edge closest to a respective cone base;

(f) the ratio of base to height of said first cone is about 1.8:1;

(g) the ratio of base to height of said second cone is about 1.8:1; and (h) the ratio of the base of said first cone to the base of said second cone is about 1.15:1.

2. The set of cones according to claim 1 wherein:

(a) said axes of rotation of said first and said second cones are angled at approximately 82° relative to an axis of rotation of a drill bit to which said first and said second cone are adapted to be attached.

* * * * *